US009863076B2

(12) United States Patent
Leonard et al.

(10) Patent No.: US 9,863,076 B2
(45) Date of Patent: Jan. 9, 2018

(54) WASHING MACHINE APPLIANCES AND METHODS FOR OPERATING THE SAME

(71) Applicant: General Electric Company, Schenectady, NY (US)

(72) Inventors: Ryan Ellis Leonard, Louisville, KY (US); Stephen Edward Hettinger, Louisville, KY (US)

(73) Assignee: HAIER US APPLIANCE SOLUTIONS, INC., Wilmingron, DE (US)

( * ) Notice: Subject to any disclaimer, the term of this patent is extended or adjusted under 35 U.S.C. 154(b) by 811 days.

(21) Appl. No.: 14/252,895

(22) Filed: Apr. 15, 2014

(65) Prior Publication Data

US 2015/0292136 A1 Oct. 15, 2015

(51) Int. Cl.
*D06F 33/02* (2006.01)
*D06F 39/00* (2006.01)

(52) U.S. Cl.
CPC ..... *D06F 33/02* (2013.01); *D06F 39/003* (2013.01); *D06F 2202/085* (2013.01); *D06F 2202/10* (2013.01); *D06F 2204/086* (2013.01)

(58) Field of Classification Search
CPC .. D06F 33/02; D06F 39/003; D06F 2202/085; D06F 2202/10; D06F 2204/086
USPC ..... 8/147, 158, 159; 68/12.04, 12.05, 12.21
See application file for complete search history.

(56) References Cited

U.S. PATENT DOCUMENTS

| | | | |
|---|---|---|---|
| 4,303,406 | A | 12/1981 | Ross |
| 5,161,393 | A | 11/1992 | Payne et al. |
| 5,669,095 | A | 9/1997 | Dausch et al. |
| 6,327,730 | B1 | 12/2001 | Corbett |
| 6,415,469 | B1 | 7/2002 | Diaz Fernandez et al. |
| 6,446,291 | B1 | 9/2002 | Diaz Fernandez et al. |
| 7,370,495 | B2 | 5/2008 | Johnson |
| 8,468,857 | B2 | 6/2013 | Nieh et al. |
| 8,505,139 | B2 | 8/2013 | Vanhazebrouck et al. |
| 2007/0101512 | A1* | 5/2007 | Lee ..... D06F 39/081 8/158 |
| 2008/0172804 | A1* | 7/2008 | Vanhazebrouck ..... D06F 39/08 8/158 |
| 2011/0247148 | A1 | 10/2011 | Chanda et al. |

FOREIGN PATENT DOCUMENTS

| | | |
|---|---|---|
| CN | 101082165 B | 3/2011 |
| JP | 10-015281 A | 1/1998 |

* cited by examiner

*Primary Examiner* — Levon J Shahinian
(74) *Attorney, Agent, or Firm* — Dority & Manning, P.A.

(57) ABSTRACT

Washing machine appliance and methods for operating washing machine appliances are provided. A method includes determining a load mass in a basket of the washing machine appliance, and flowing water into a tub until a predetermined tub water indicator level is met, wherein the basket is disposed in the tub. The method further includes estimating a first volume of water in the tub after the predetermined tub water indicator level is met, and determining a load type based on the load mass and the first volume of water. The method further includes flowing water into the tub until a secondary indicator level for the determined load mass is met if the determined load type is a low pressure indicator.

16 Claims, 5 Drawing Sheets

WASHING MACHINE APPLIANCES AND METHODS FOR OPERATING THE SAME

FIELD OF THE INVENTION

The present disclosure relates generally to washing machine appliances, and more particularly to methods and apparatus for operating washing machine appliances which detect and resolve low inlet pressure conditions.

BACKGROUND OF THE INVENTION

Washing machine appliances generally include a tub for containing wash fluid, e.g., water and detergent, bleach and/or other wash additives. A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

One issue with washing machine appliance performance has been the inlet pressure of water being flowed into the appliance. In many areas of the world, such as in Latin America, water pressure is of constant concern, and high water pressure is not always available. Additionally, water obtained from wells can have low pressure, or sediment build-up in the water line or on a filter screen can reduce the water pressure. Low pressure inlet water flow can lead to inadequate water in the washing machine appliance during operation, leading to poor performance and user dissatisfaction.

Some washing machine appliances utilize flow regulators to regulate the water pressure into the appliances. However, the addition of a flow regulator to a washing machine appliance increases the cost of the appliance. Areas where low pressures are of concern are the same areas where flow regulators may not be affordable. Additionally, at extreme low pressures, flow regulators will not function properly.

Further, currently known washing machine appliances generally cannot distinguish between low pressure conditions and flood conditions (where the appliance is overfilled) . Accordingly, if an issue is detected, the appliance simply shuts off the water supply. Users may then be required to manually add water to the appliance to obtain proper performance.

Accordingly, improved washing machine appliances and methods for operating washing machine appliances are desired in the art. In particular, washing machine appliances and methods having improved low inlet pressure condition detection and resolution capabilities would be advantageous.

BRIEF DESCRIPTION OF THE INVENTION

In accordance with one embodiment of the present disclosure, a method for operating a washing machine appliance is provided. The method includes determining a load mass in a basket of the washing machine appliance, and flowing water into a tub until a predetermined tub water indicator level is met, wherein the basket is disposed in the tub. The method further includes estimating a first volume of water in the tub after the predetermined tub water indicator level is met, and determining a load type based on the load mass and the first volume of water. The method further includes flowing water into the tub until a secondary indicator level for the determined load mass is met if the determined load type is a low pressure indicator.

In accordance with another embodiment of the present disclosure, a washing machine appliance is provided. The washing machine appliance includes a tub, and a basket rotatably mounted within the tub, the basket defining a wash chamber for receipt of articles for washing. The washing machine appliance further includes a main valve in fluid communication with an external water source, a nozzle configured for flowing water from the valve into the tub, and a pressure sensor mounted in the tub. The washing machine appliance further includes a motor in mechanical communication with the basket, the motor configured for selectively rotating the basket within the tub, and a controller in operative communication with the valve, pressure sensor and motor. The controller is operable for determining a load mass in a basket of the washing machine appliance, and flowing water into a tub until a predetermined tub water indicator level is met, wherein the basket is disposed in the tub. The controller is further operable for estimating a first volume of water in the tub after the predetermined tub water indicator level is met, and determining a load type based on the load mass and the first volume of water. The controller is further operable for flowing water into the tub until a secondary indicator level for the determined load mass is met if the determined load type is a low pressure indicator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
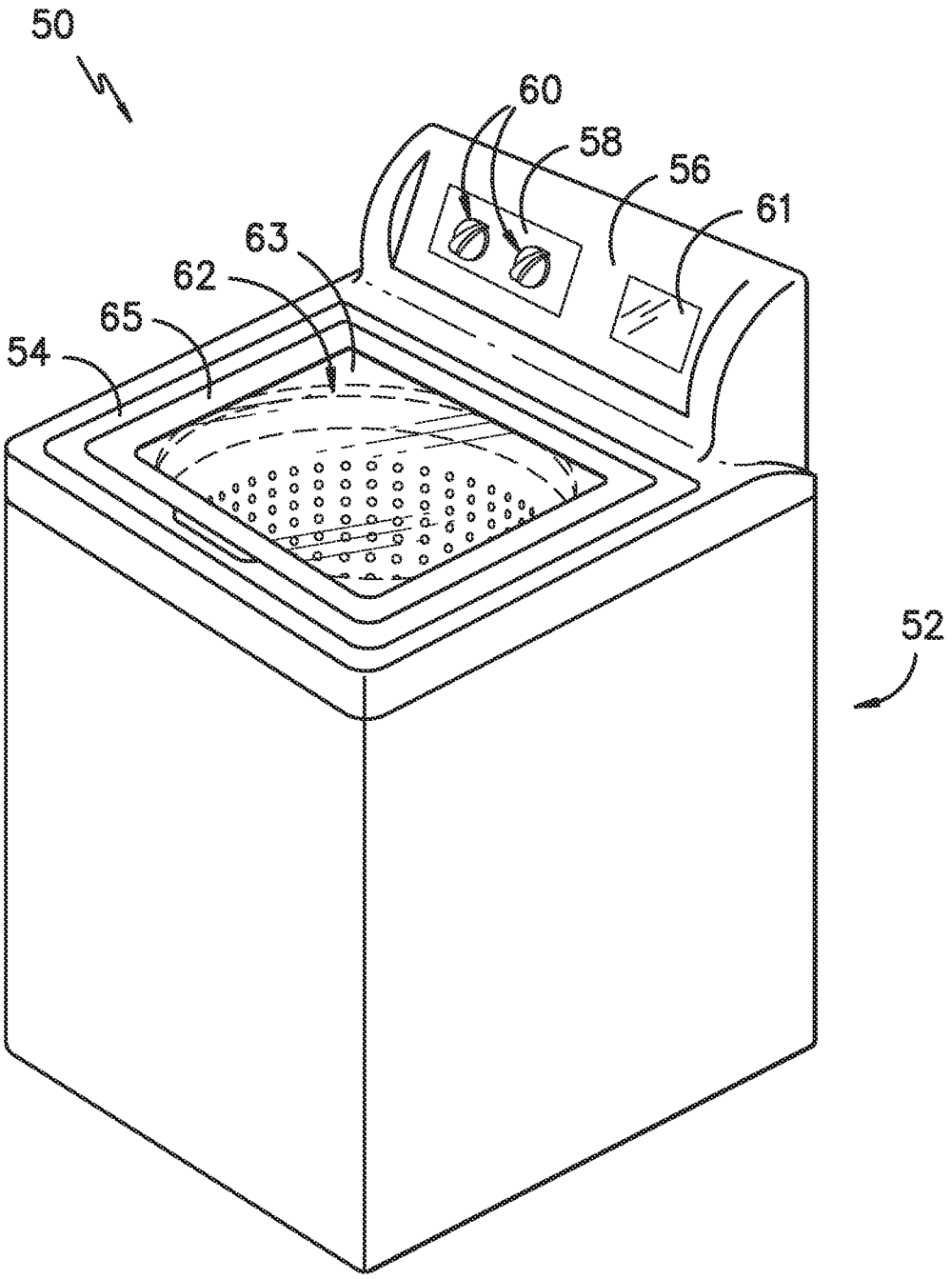
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Lid 62 in exemplary embodiment includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
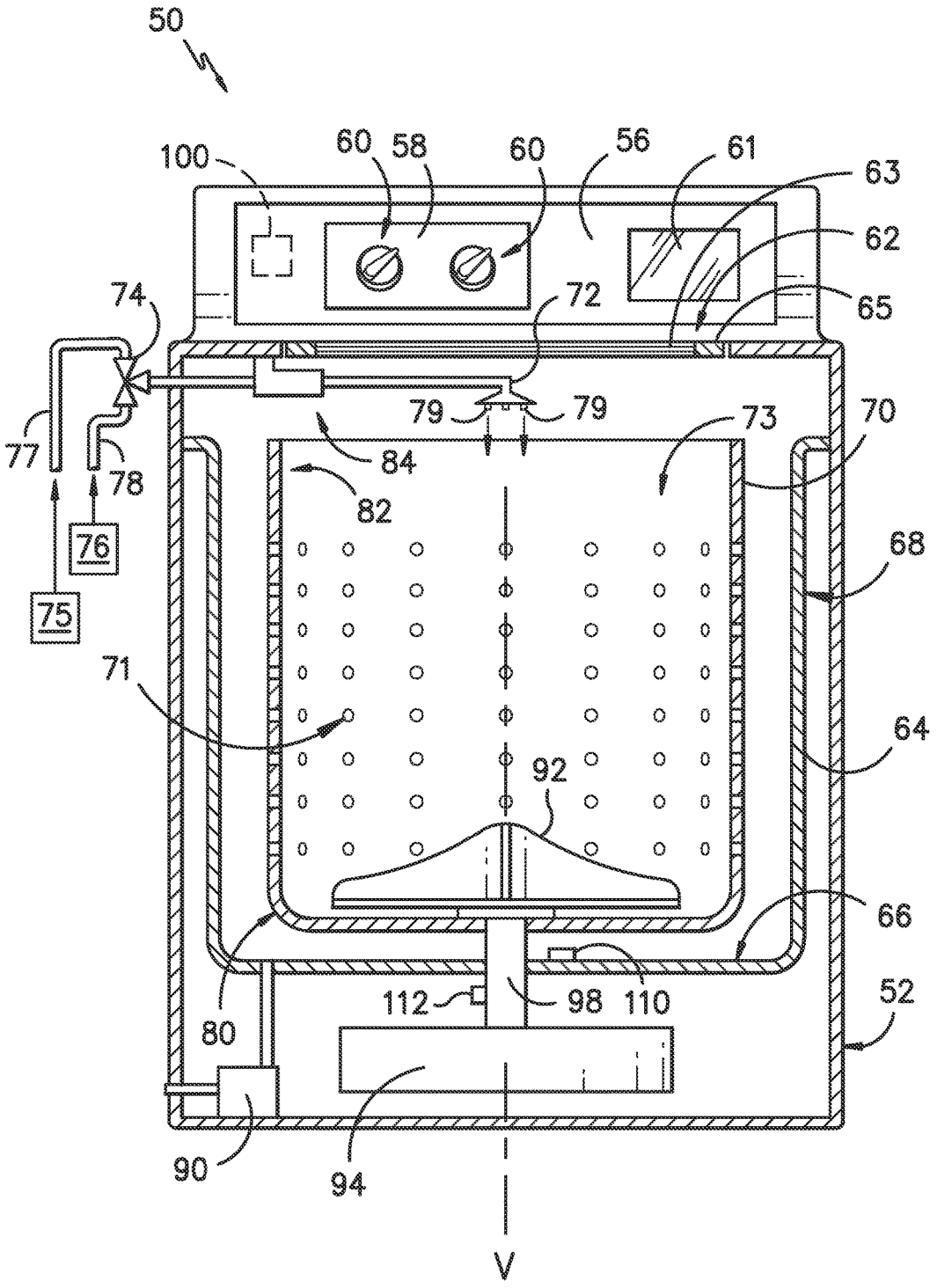
FIG. 2 provides a front, section view of a washing machine appliance in accordance with one embodiment of the present disclosure.

FIG. 2 provides a front, cross-section views of washing machine appliance 50. As may be seen in FIG. 2, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 and/or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

A main valve 74 (or, alternatively, a plurality of main valves 74) regulates the flow of fluid through nozzle 72. For example, valve 74 can selectively adjust to a closed position in order to terminate or obstruct the flow of fluid through nozzle 72. The main valve 74 may be in fluid communication with one or more external water sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the main valve 74. A cold water conduit 77 and a hot water conduit 78 may supply cold and hot water, respectively, from the sources 75, 76 through valve 74. Valve 74 may further be operable to regulate the flow of hot and cold liquid, and thus the temperature of the resulting liquid flowed into tub 64, such as through the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIG. 2) is located beneath tub 64 and basket 70 for gravity assisted flow to drain tub 64.

An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Alternatively, basket 70 may provide such agitating movement, and agitation element 92 is not required. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated. Any suitable pressure sensor 110, such as an electronic sensor, a manometer, or another suitable gauge or sensor, may be utilized. The pressure sensor 110 may generally measure the pressure of water in the tub 64. This pressure can then be utilized to estimate the height or level of water in the tub 64. Additionally, a suitable speed sensor 112 can be connected to the motor 94, such as to the output shaft 98 thereof, to measure speed and indicate operation of the motor 94. Other suitable sensors, such as temperature sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as main valve 74, motor 94, pressure sensor 110, speed sensor 112, and other suitable sensors, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or microcontrol code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, a load of laundry articles are loaded into chamber 73 of basket 70, and washing operation is initiated through operator manipulation of control input selectors 60. Tub 64 is filled with water and mixed with detergent to form a liquid or wash fluid. Main valve 74 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70. More specifically, agitation element 92 or basket 70 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 or basket 70 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
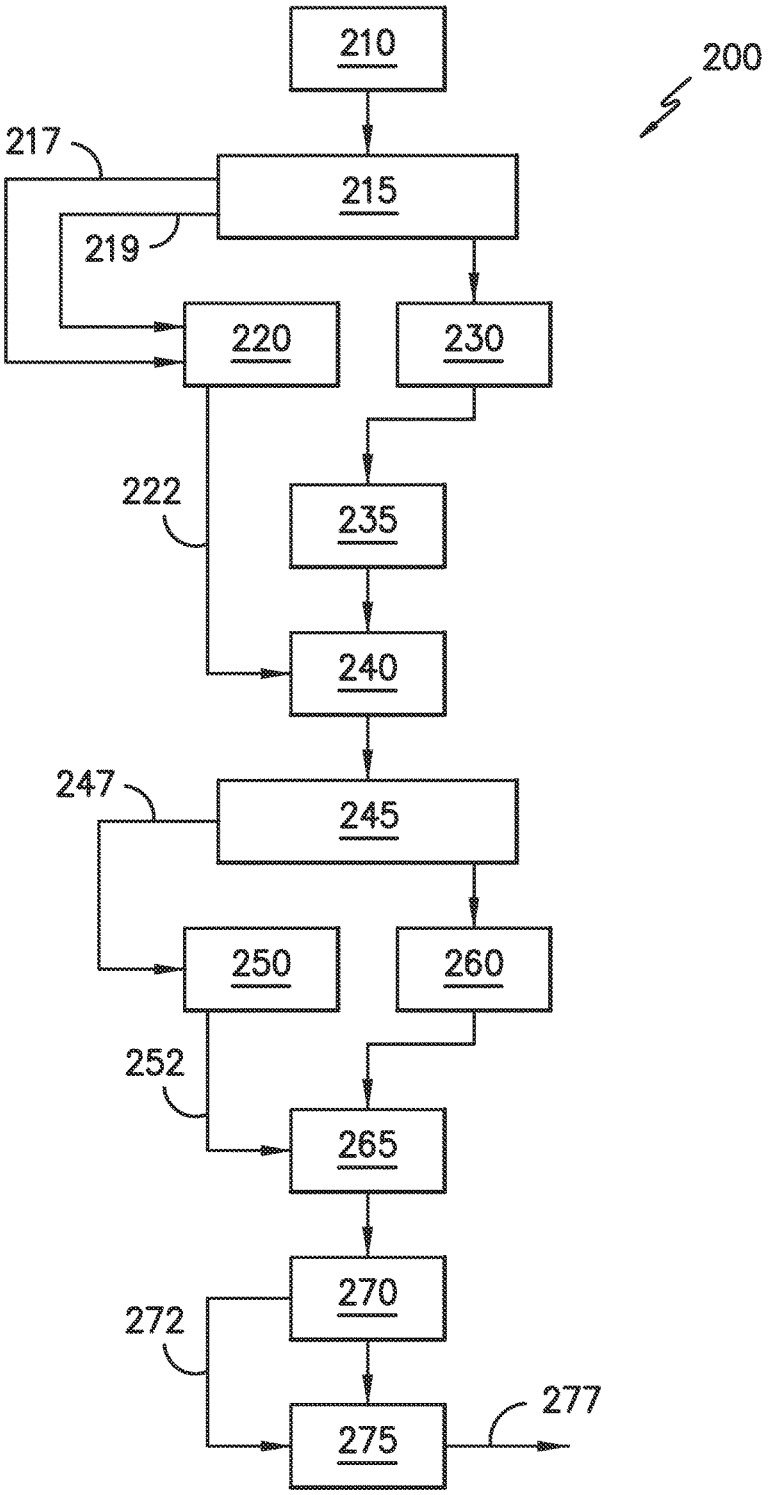
FIG. 3 provides a flow chart of an exemplary method for determining a load mass in a washing machine appliance according to an exemplary embodiment of the present subject matter.
Figure 4:
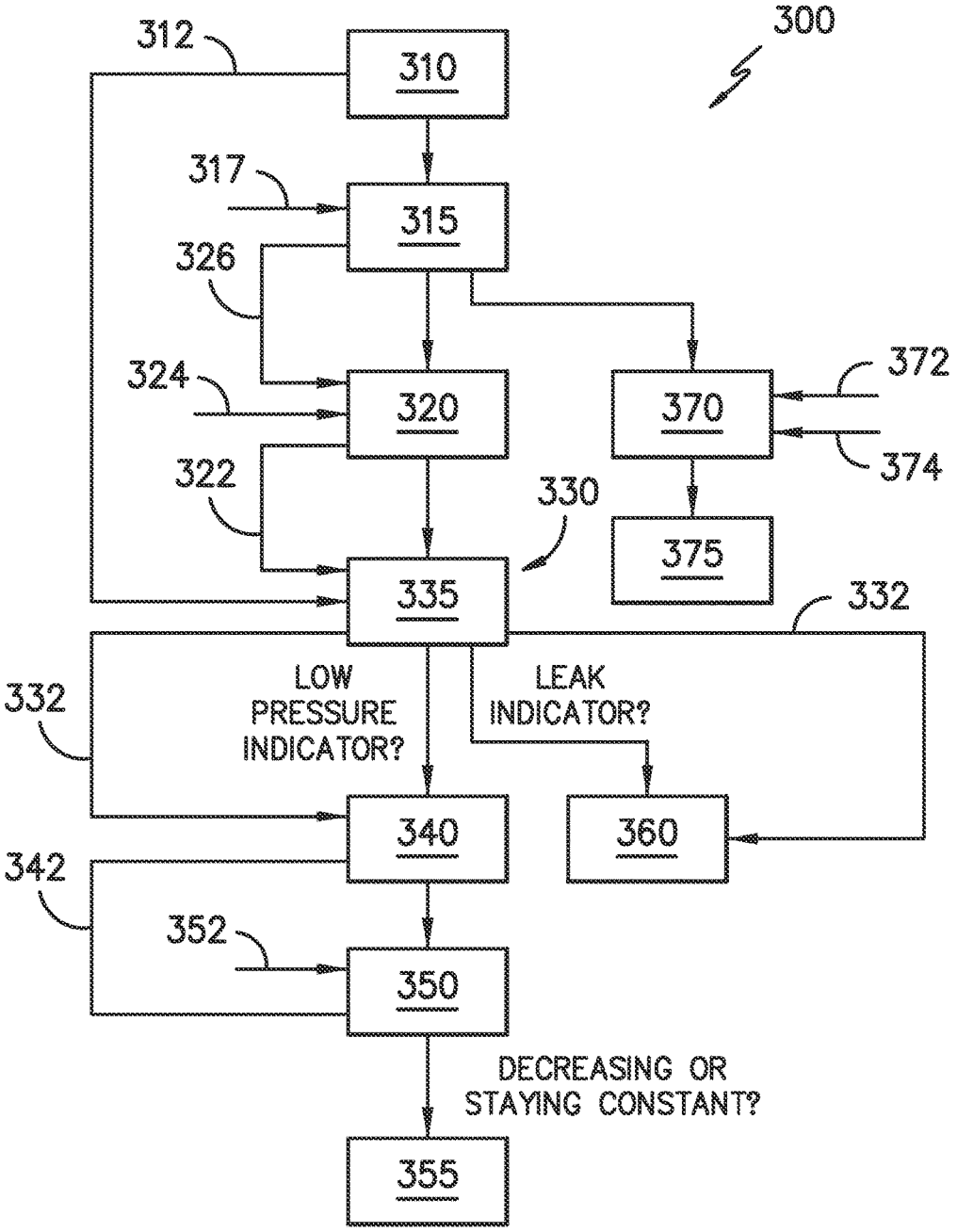
FIG. 4 provides a flow chart of an exemplary method for operating a washing machine appliance according to an exemplary embodiment of the present subject matter.

Referring now to FIGS. 3 and 4, various methods may be provided for use with washing machine appliances 50 in accordance with the present disclosure. In general, the various steps of methods as disclosed herein may in exemplary embodiments be performed by the controller 100, which may receive inputs and transmit outputs from various other components of the appliance 50.

For example, as illustrated in FIG. 3 and indicated by reference number 200, methods for determining a load mass in a washing machine appliance 50 are provided. Such methods 200 generally accurately and efficiently determined the mass of a load of articles loaded into a basket 70 for washing. Such mass calculation can advantageously be utilized to tailor various operating conditions of the appliance 50, such as agitation time, agitation profile, spin speed, spin time, etc. for optimal performance. Further, such mass calculations can be utilized for additional determinations by the appliance 50, such as of the load type.

A method 200 may include, for example, the step 210 of initially activating the motor 94 to spin the basket 70 of the washing machine appliance 50. Such step 210 is generally performed after articles forming a load are loaded into the basket 70, and before water is flowed into the tub 64 to begin washing of the load. Accordingly, the load mass determined utilizing method 200 is generally a dry load mass. Method 200 may further include, for example, the step 215 of measuring at least one of current 217 or voltage 219 of the motor 94 during the initially activating step 210. The current 217 and/or voltage 219 may, for example, be measured by the controller 100 in communication with the motor 94, such as through the use of suitable sensors included in or in communication with the motor 94.

Method 200 may further include, for example, the step 220 of calculating a motor ramp up time 222 based the current 217 and/or voltage 219. The ramp up time 222 may generally be a time allotted for the motor 94, when activated, to run before being deactivated for purposes of the present method. Activation may be from a zero velocity state or from suitable predetermined low velocity. The motor ramp up time 222 can be calculated based on the current 217 and/or voltage 219 using, for example, a suitable transfer function or other suitable mathematical relationship. For example, the present inventors have empirically developed relationships between motor ramp up time 222 and current 217 and/or voltage 219, based for example on the relationship between current 217 and motor input torque. In this manner, determination of the load mass as disclosed herein compensates for the input torque.

In some embodiments, a method 200 may further include the step 230 of deactivating the motor 94 after measuring the current 217 and/or voltage 219. In these embodiments, method 200 may then include the step 235 of intermediately activating the motor 94 to spin the basket 70, for a second time. Subsequent steps, as discussed herein, may then follow. In alternative embodiments, such subsequent steps may follow without the need to deactivate and then intermediately activate the motor 94. In these embodiments, adjustments may be made, such as by the controller 100, in real time based on, for example, motor ramp up time 222.

Method 200 may further include, for example, the step 240 of deactivating the motor 94 after the motor ramp up time 222 has expired. Such deactivation can occur, as discussed, after the second activation 235, or after the initial activation 210 once the motor ramp up time 222 has been calculated in real time.

Method 200 may further include, for example, the step 245 of measuring a first motor coast down time 247. The coast down time 247 is generally the time that the motor 94 takes to reach zero velocity or a predetermined low velocity once the motor 94 has been deactivated. Still further, method 200 may include, for example, the step 250 of calculating a motor velocity 252 based on the first motor coast down time 247. The motor velocity 252 can be calculated based on the first motor coast down time 247 using, for example, a suitable transfer function or other suitable mathematical relationship. For example, the present inventors have empirically developed relationships between first motor coast down time 247 and motor velocity 252, based for example on the relationship between first motor coast down time 247 and motor friction. In this manner, determination of the load mass as disclosed herein compensates for the motor friction.

Method 200 may further include, for example, the step 260 of finally activating the motor 94 to spin the basket 70. Further, method 200 may include the step 265 of deactivating the motor 94 after the motor velocity 252 has been reached. Still further, method 200 may include the step 270 of measuring a second motor coast down time 272. The coast down time 272 is generally the time that the motor 94 takes to reach zero velocity or a predetermined low velocity once the motor 94 has been deactivated.

Method 200 may further include, for example, the step 275 of calculating a load mass 277 in the basket 70 based on the second motor coast down time 272. The load mass 277 can be calculated based on the second motor coast down time 272 using, for example, a suitable transfer function or other suitable mathematical relationship. For example, the present inventors have empirically developed relationships between second motor coast down time 272 and load mass 277, based for example on the relationship between second motor coast down time 272 and moment of inertia.

Accordingly, the mass 277 of a load of articles loaded into a basket 70 can efficiently and accurately be determined through the use of a series of motor 94 activations. As discussed, operations of the washing machine appliance 50 can advantageously be tailored using this known mass 277, and the mass 277 can further be utilized for other purposes, such as to determine a load type as discussed herein.

Referring now to FIG. 4, a method 300 for operating a washing machine appliance 50 is disclosed. The methods 300 may include various steps for determining whether a low pressure condition occurs and resolving the low pressure issue. A low pressure condition is generally a condition wherein the inlet pressure of water into the appliance 50, such as through main valve 74, is below a desired or predetermined threshold. When a low pressure condition has occurred, various calculations and steps typically performed by the appliance 50, such as by the controller 100, may become inaccurate. This may be due, for example, to inlet pressure assumptions made for purposes of these calculations and steps. Accordingly, if a low pressure condition has occurred, the present disclosure advantageously provides backup methodology for relatively accurately flowing water into the appliance 50 and generally facilitating operation of the appliance 50.

For example, method 300 may include the step 310 of determining the load mass 312 in the basket 64. In some exemplary embodiments, method 200 may be utilized to determine the load mass, and the load mass 277 may be utilized as the load mass 312 in the method 300. Alternatively, any suitable method and/or apparatus may be utilized to determine the load mass 312.

Method 300 may further include, for example, the step 315 of flowing water into the tub 64 until a predetermined tub water indicator level 317 is met. The indicator level 317 may be, for example, a pressure level determined by, for example, the pressure sensor 110. Alternatively, the indicator level 317 may be an inductance or voltage level in conjunction with movement of a float, or another suitable indicator level in conjunction with another suitable device. The indicator level 317 may be correlated with a desired threshold for the water level in the tub 64, such that meeting the indicator level 317 would theoretically mean that the water level threshold is met. Further, method 300 may include the step 320 of estimating a first volume of water 322 in the tub 64 after the predetermined tub indicator level 317 is met. The level 317 and volume 322 can be correlated such that the volume 322 can be estimated. For example, in some embodiments, the estimating step 320 is further based on an assumed flow rate 324 of water into the tub 64. The assumed flow rate 324 is an assumed rate at which water will flow from, for example, main valve 74 to the tub 64. Suitable flow regulators may, in some embodiments, be utilized in the appliance 50 such that the actual flow rate can be adjusted to a rate approximating the assumed flow rate 324. Alternatively, however, no such flow regulators may be utilized. Further, in some embodiments, the estimating step 320 is further based on a time 326 that water is flowed into the tub 64 until the predetermined tub water indicator level 317 is met. For example, a timer (such as of controller 100) may start when water begins to flow into the tub 64 and stop when the predetermined tub water indicator level 317 is met, thus providing the time 326 correlated to the indicator level 317. Accordingly, in exemplary embodiments, the assumed flow rate 324 is known, as is the time 326 required for the indicator level 317 to be met. Based on these variables (indicator level 317 being met, resulting time 326 to meet such indicator level 317, and assumed flow rate 324), the first volume of water 322 can be estimated.

Figure 5:
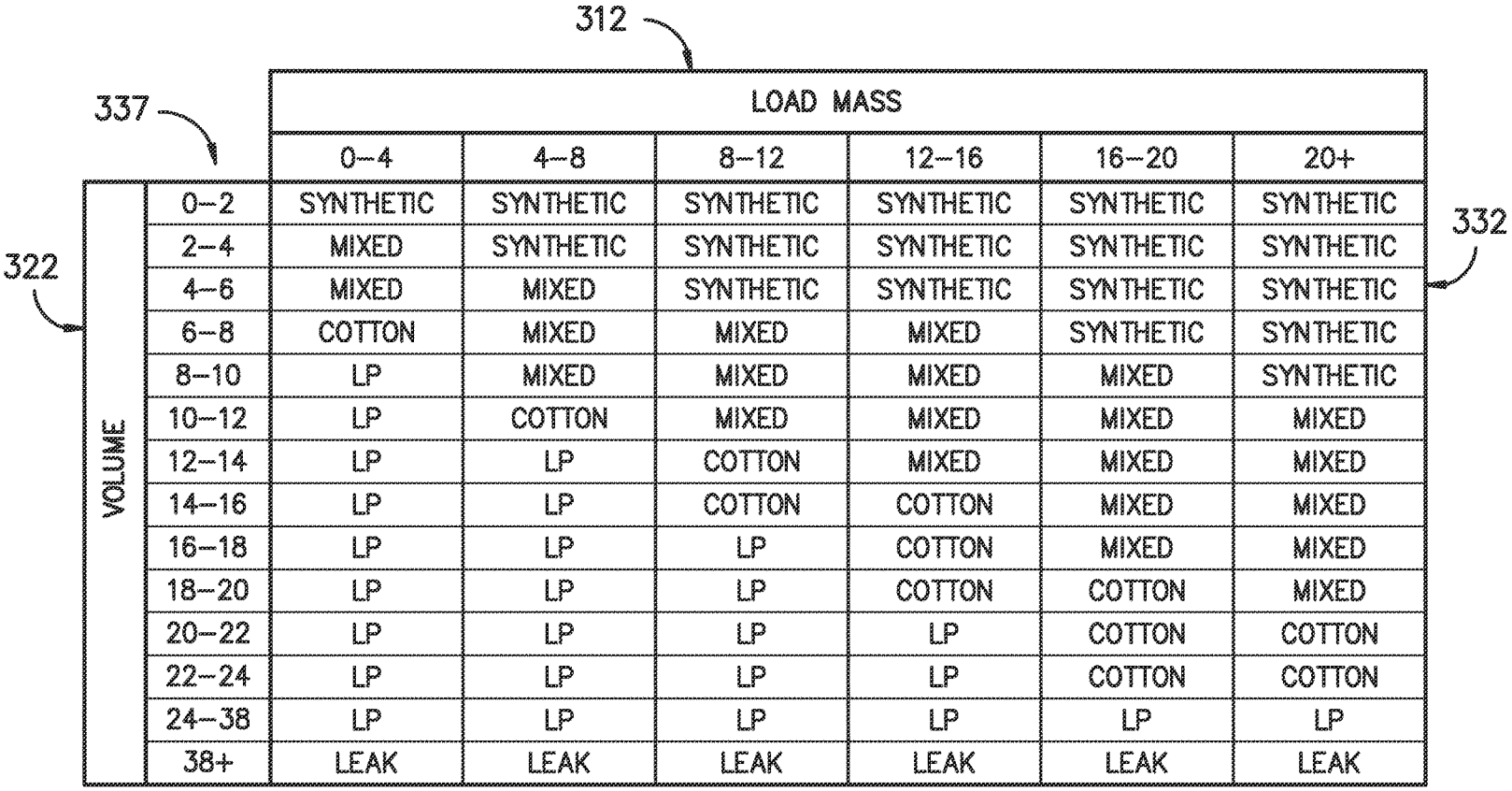
FIG. 5 provides a look-up table which cross-references load mass and volume to determined load type according to an exemplary embodiment of the present subject matter.

Method 300 may include the step 330 of determining a load type 332. The load type 332 may be based on the load mass 312 and the first volume of water 322. For example, in exemplary embodiments, step 330 may include the step 335 of cross-referencing the load mass 312 and the first volume of water 322 in a look-up table 337. FIG. 5 illustrates one embodiment of a look-up table 337, with non-limiting examples of load mass 312 categories, first volume of water 322 categories, and resulting load types 332. (It should be noted that load mass 312 may be converted to weight for purposes of cross-referencing, or at any other point during utilization of a method in accordance with the present disclosure. The use of the term mass may thus be considered to include the term weight). Such categories may generally be based on the absorbency of various types of articles, such as synthetic articles and cotton articles. Since cotton tends to be more absorbent than synthetics, more water would be required for the same load size. Accordingly, a higher first volume of water 322 would be expected for a load mass 312 of cotton as opposed to the same load mass 312 of synthetics. It should be understood that the present disclosure is not limited to cotton, synthetic, and mixed (cotton and synthetic) categories, and rather that any suitable categories of load types 332, as well as any suitable load mass 312 categories and first volume of water 322 categories, are within the scope and spirit of the present disclosure. Look-up table 337 may generally be programmed into the controller 100, such that controller 100 can generally perform the steps as disclosed herein.

It should be noted from FIG. 5 that for some load mass 312/first volume 322 levels, the resulting load type 332 is a "LP". "LP" stands for low pressure, and is thus a low pressure indicator which indicates that a low water pressure condition may exist. Notably, such condition may generally occur when the first volume 322 is particularly, and perhaps improperly, high for a given load mass 312. Method 300 may thus further include, for example, the step 340 of flowing water into the tub 64 until a predetermined secondary indicator level 342 for the determined load mass 312 is met. Secondary indicator level 342 may, for example, be a pressure level or an inductance or voltage level or other suitable level correlated with water level in the tub 64. Such step 340 may occur, for example, if the determined load type 332 is a low pressure indicator. Such step thus, based on the low pressure indicator, converts from load type detection to a backup fill method which utilizes the secondary indicator level 342. The secondary indicator level 342 may, for example, be above the predetermined indicator level 317. In some embodiments, the secondary indicator level 342 may be predetermined based on, for example, a mixed load, and may thus be intended to correspond to an average amount of water flowed into the tub 64 for such mixed load. In other embodiments, the secondary indicator level 342 may be predetermined based on a synthetic load, and may thus be intended to correspond to a conservative amount of water flowed into the tub 64 for such synthetic load.

In some embodiments, method 300 may further include the step 350 of comparing an actual indicator level 352 to the secondary indicator level 342 during the flowing step 340. Actual indicator level 342 may, for example, be a pressure level or an inductance or voltage level or other suitable level correlated with water level in the tub 64. The actual indicator level 352 may for example be the real time indicator level, as indicated by the pressure sensor 110 or other device, during the flowing step 340. Further, method 300 may include the step 355 of discontinuing operation of the washing machine appliance 50 in the actual indicator level 352 is decreasing or staying constant during the flowing step 340. If the actual indicator level 352 is not rising during the flowing step 340, there may be a technical issue with, for example, the pressure sensor 110, controller 100, or another component. Accordingly, the comparing step 350 and discontinuing step 355 may act as safeguards to prevent overflowing of the tub 64 and appliance 50 in general. Discontinuing operation of the washing machine appliance 50 may include discontinuing the flow of water to the appliance 50, but allowing a wash and/or rinse cycle to occur, or may include discontinuing the flow of water to the appliance 50, draining the water, and not allowing any further cycle or other action by the appliance 50.

Additional safeguards may be provided in methods in accordance with the present disclosure. For example, it should be noted from FIG. 5 that for some load mass 312/first volume 322 levels, the resulting load type 332 is "Leak". "Leak" is a leak indicator which indicates that the appliance 50, such as the tub 64 thereof, may have a leak. Notably, such condition may generally occur when the first volume 322 is particularly, and perhaps improperly, high (even above a low pressure indicator level) for a given load mass 312. Method 300 may thus further include, for example, the step 360 of discontinuing operation of the washing machine appliance 50 if the determined load type is a leak indicator. Discontinuing operation of the washing machine appliance 50 may include discontinuing the flow of water to the appliance 50, but allowing a wash and/or rinse cycle to occur, or may include discontinuing the flow of water to the appliance 50, draining the water, and not allowing any further cycle or other action by the appliance 50.

Methods 300 may further include, for example, the step 370 of comparing a real time volume of water 372 to a predetermined maximum volume of water 374 for the tub 64. Such step 370 may occur, for example, during the flowing step 315. The real time volume of water 372 may be estimated during the flowing step 315 in real time in the same manner as the step 320 of estimating the first volume of water 322. Method 300 may further include the step 375 of discontinuing operation of the washing machine appliance 50 if the real time volume of water 372 is greater than the predetermined maximum volume of water 372 for the tub 64. This real time monitoring may prevent overflowing of the tub 64 during the flowing step 315 before the first volume of water 322 is estimated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the method comprising:

determining a load mass in a basket of the washing machine appliance, determining the load mass comprises:

initially activating a motor to spin a basket of the washing machine appliance;

measuring at least one of current or voltage of the motor during the initially activating step;

calculating a motor ramp up time based on the at least one of current or voltage;

deactivating the motor after the motor ramp up time has expired;

measuring a first motor coast down time;

calculating a motor velocity based on the first motor coast down time;

finally activating the motor to spin the basket;

deactivating the motor after the motor velocity has been reached;

measuring a second motor coast down time; and calculating a load mass in the basket based on the second motor coast down time;

flowing water into a tub until a predetermined tub water indicator level is met, wherein the basket is disposed in the tub;

estimating a first volume of water in the tub after the predetermined tub water indicator level is met;

determining a load type based on the load mass and the first volume of water; and flowing water into the tub until a secondary indicator level for the determined load mass is met if the determined load type is a low pressure indicator.

2. The method of claim 1, wherein estimating the first volume of water is further based on an assumed flow rate of water into the tub.

3. The method of claim 1, wherein determining the load type comprises cross-referencing the load mass and the first volume of water in a look-up table.

4. The method of claim 1, further comprising discontinuing operation of the washing machine appliance if the determined load type is a leak indicator.

5. The method of claim 1, further comprising comparing an actual indicator level to the secondary indicator level during the step of flowing water into the tub until the secondary indicator level for the determined load mass is met.

6. The method of claim 5, further comprising discontinuing operation of the washing machine appliance if the actual indicator level is decreasing or staying constant during the step of flowing water into the tub until the secondary indicator level for the determined load mass is met.

7. The method of claim 1, further comprising comparing a real time volume of water to a predetermined maximum volume of water for the tub during flowing water into the tub until the predetermined tub water indicator level is met.

8. The method of claim 7, further comprising discontinuing operation of the washing machine appliance if the real time volume of water is greater than the predetermined maximum volume of water for the tub.

9. A washing machine appliance, comprising:

a tub;

a basket rotatably mounted within the tub, the basket defining a wash chamber for receipt of articles for washing;

a main valve in fluid communication with an external water source;

a nozzle configured for flowing water from the valve into the tub;

a pressure sensor mounted in the tub;

a motor in mechanical communication with the basket, the motor configured for selectively rotating the basket within the tub; and a controller in operative communication with the valve, pressure sensor and motor, the controller operable for:

determining a load mass in the basket of the washing machine appliance, determining the load mass comprises:

initially activating a motor to spin a basket of the washing machine appliance;

measuring at least one of current or voltage of the motor during the initially activating step;

calculating a motor ramp up time based on the at least one of current or voltages;

deactivating the motor after the motor ramp up time has expired;

measuring a first motor coast down time;

calculating a motor velocity based on the first motor coast down time;

finally activating the motor to spin the basket;

deactivating the motor after the motor velocity has been reached;

measuring a second motor coast down time; and calculating a load mass in the basket based on the second motor coast down time;

flowing water into the tub until a predetermined tub water indicator level is met, wherein the basket is disposed in the tub;

estimating a first volume of water in the tub after the predetermined tub water indicator level is met;

determining a load type based on the load mass and the first volume of water; and flowing water into the tub until a secondary indicator level for the determined load mass is met if the determined load type is a low pressure indicator.

10. The washing machine appliance of claim 9, wherein estimating the first volume of water is further based on an assumed flow rate of water into the tub.

11. The washing machine appliance of claim 9, wherein determining the load type comprises cross-referencing the load mass and the first volume of water in a look-up table.

12. The washing machine appliance of claim 9, wherein the controller is further operable for discontinuing operation of the washing machine appliance if the determined load type is a leak indicator.

13. The washing machine appliance of claim 9, wherein the controller is further operable for comparing an actual indicator level to the secondary indicator level during the step of flowing water into the tub until the secondary indicator level for the determined load mass is met.

14. The washing machine appliance of claim 13, wherein the controller is further operable for discontinuing operation of the washing machine appliance if the actual indicator level is decreasing or staying constant during the step of flowing water into the tub until the secondary indicator level for the determined load mass is met.

15. The washing machine appliance of claim 9, wherein the controller is further operable for comparing a real time volume of water to a predetermined maximum volume of water for the tub during flowing water into the tub until the predetermined tub water indicator level is met.

16. The washing machine appliance of claim 15, wherein the controller is further operable for discontinuing operation of the washing machine appliance if the real time volume of water is greater than the predetermined maximum volume of water for the tub.

* * * * *